US010931025B2

(12) United States Patent
Yoshida

(10) Patent No.: US 10,931,025 B2
(45) Date of Patent: Feb. 23, 2021

(54) METHOD FOR DESIGNING GRADIENT INDEX LENS AND ANTENNA DEVICE USING SAME

(71) Applicant: NEC Corporation, Tokyo (JP)

(72) Inventor: Takahide Yoshida, Tokyo (JP)

(73) Assignee: NEC CORPORATION, Tokyo (JP)

( * ) Notice: Subject to any disclaimer, the term of this patent is extended or adjusted under 35 U.S.C. 154(b) by 517 days.

(21) Appl. No.: 15/578,823

(22) PCT Filed: Jun. 13, 2016

(86) PCT No.: PCT/JP2016/002822
§ 371 (c)(1),
(2) Date: Dec. 1, 2017

(87) PCT Pub. No.: WO2016/203748
PCT Pub. Date: Dec. 22, 2016

(65) Prior Publication Data

US 2018/0166792 A1 Jun. 14, 2018

(30) Foreign Application Priority Data

Jun. 15, 2015 (JP) ..... JP2015-120046

(51) Int. Cl.
*H01Q 19/08* (2006.01)
*H01Q 3/14* (2006.01)
(Continued)

(52) U.S. Cl.
CPC ..... *H01Q 19/08* (2013.01); *H01Q 1/1264* (2013.01); *H01Q 3/14* (2013.01); *H01Q 15/08* (2013.01); *H01Q 19/065* (2013.01)

(58) Field of Classification Search
CPC .... G02B 3/0087; H01Q 19/06; H01Q 19/062; H01Q 19/065; H01Q 19/08; H01Q 15/02; H01Q 15/08
See application file for complete search history.

(56) References Cited

U.S. PATENT DOCUMENTS 4,950,862 A * 8/1990 Kajikawa ..... B23K 26/04 219/121.68
5,757,464 A * 5/1998 Volk ..... A61B 3/125 351/205

(Continued)

FOREIGN PATENT DOCUMENTS

JP H08-094489 A 12/1996
JP 2000-244237 A 9/2000

(Continued)

OTHER PUBLICATIONS

International Search Report for PCT Application No. PCT/JP2016/002822, dated Jul. 19, 2016.

(Continued)

*Primary Examiner* — Ab Salam Alkassim, Jr.

(57) ABSTRACT

An object of the present invention is to provide a method for designing a gradient index lens enabling to easily and accurately drive an antenna. According to the present invention, a virtual domain a boundary of which includes a curved focal plane in a uniform-refractive-index type lens with a uniform refractive index, and a physical domain a boundary of which includes a planar focal plane in a gradient index lens with a non-uniform refractive index and that is a quasiconformal map of the virtual domain are set, the quasiconformal map of a virtual medium parameter that is a medium parameter including at least one of a dielectric constant and magnetic permeability characterizing the virtual domain is calculated as a physical medium parameter in the physical domain, and the gradient index lens based on the physical medium parameter is designed by spatially arranging a medium parameter adjustment element set in advance.

9 Claims, 14 Drawing Sheets

(51) Int. Cl.

| | |
|---|---|
| ***H01Q 19/06*** | (2006.01) |
| ***H01Q 15/08*** | (2006.01) |
| ***H01Q 1/12*** | (2006.01) |

(56) References Cited

U.S. PATENT DOCUMENTS

| | | | | |
|---|---|---|---|---|
| 5,949,365 | A * | 9/1999 | Wagner | G01S 13/48 342/70 |
| 6,011,860 | A * | 1/2000 | Fujieda | G06K 9/00899 382/126 |
| 6,246,375 | B1 * | 6/2001 | Yamada | H01Q 3/14 343/753 |
| 6,310,582 | B1 * | 10/2001 | Uetake | H01Q 3/08 343/765 |
| 7,006,049 | B1 * | 2/2006 | Loane | H01Q 15/161 343/779 |
| 8,848,295 | B2 * | 9/2014 | Smith | G02B 3/0087 359/652 |
| 2002/0097661 | A1 * | 7/2002 | Itonaga | G11B 7/13922 369/112.23 |
| 2006/0202909 | A1 | 9/2006 | Nagai | |
| 2010/0001900 | A1 * | 1/2010 | Imai | G01S 7/03 342/195 |
| 2011/0116170 | A1 * | 5/2011 | Smith | G02B 3/0087 359/652 |
| 2014/0285373 | A1 * | 9/2014 | Kuwahara | G01S 13/931 342/27 |
| 2015/0168601 | A1 | 6/2015 | Suzuki | |
| 2018/0183152 | A1 * | 6/2018 | Turpin | H01Q 1/288 |
| 2018/0354844 | A1 * | 12/2018 | Drazic | G02B 6/32 |
| 2019/0101700 | A1 * | 4/2019 | Boriskin | G02B 27/56 |

FOREIGN PATENT DOCUMENTS

| | | | |
|---|---|---|---|
| JP | 3548820 | B2 | 7/2004 |
| JP | 5040917 | B2 | 10/2012 |
| JP | 2013-506884 | A | 2/2013 |
| WO | 2005/034291 | A1 | 4/2005 |
| WO | 2013/121686 | A1 | 8/2013 |

OTHER PUBLICATIONS

English translation of Written opinion for PCT Application No. PCT/JP2016/002822.

Japanese Office Action for JP Application No. 2017-524600 dated Mar. 31, 2020 with English Translation.

* cited by examiner

METHOD FOR DESIGNING GRADIENT INDEX LENS AND ANTENNA DEVICE USING SAME

This application is a National Stage Entry of PCT/JP2016/002822 filed on Jun. 13, 2016, which claims priority from Japanese Patent Application 2015-120046 filed on Jun. 15, 2015, the contents of all of which are incorporated herein by reference, in their entirety.

TECHNICAL FIELD

The present invention relates to a method for designing a gradient index lens, and an antenna device using the same.

BACKGROUND ART

Accompanying recent progress of a technique of an antenna and a technique for manufacturing the antenna, research and development has been made on a lens capable of controlling a direction of an emission beam. For example, PTL 1 proposes an antenna device 100 including a dielectric lens 101 and a primary radiator 102 as illustrated in FIG. 13. This primary radiator 102 can be moved along a motion route 103 curved at a phase center, while the orientation is turned toward the center of the dielectric lens 101. Accordingly, the orientation of a beam can be controlled by moving the primary radiator 102 along the motion route 103.

Further, PTL 2 proposes a radar device in which primary radiators 114 and 115 are provided around spherical lenses 112 and 113, and the primary radiators 114 and 115 are made to be rotatable in an elevation direction, as illustrated in FIG. 14. By rotating the primary radiators 114 and 115, an RF wave is radiated in a direction opposite with respect to the lenses 112 and 113. Further, a mechanical mechanism for rotating the lenses 112 and 113 and the primary radiators 114 and 115 also in an azimuth direction is provided so that an RF wave can be scanned in the azimuth direction.

CITATION LIST

Patent Literature

[PTL 1] Japanese Patent No. 3548820
[PTL 2] Japanese Patent No. 5040917
[PTL 3] Japanese Laid-open Patent Publication No. H8-094489
[PTL 4] Japanese Translation of PCT International Publication No. 2013-506884

SUMMARY OF INVENTION

Technical Problem

However, according to the configuration of PTL 1, since at a time of moving the primary radiator 102, it is necessary to mechanically control two parameters as a direction and a position of the primary radiator 102, there is a problem that a control mechanism becomes complicated.

Further, according to the configuration of PTL 2, since the lenses 112 and 113 are spherical, when controlling an elevation direction and an azimuth direction of an antenna beam, there is a problem that a rotation mechanism becomes complicated and large in size.

These problems are factors in increase in weight, cost, and the like of an antenna device.

In view of above, a main object of the present invention is to provide a method for designing a gradient index lens enabling to easily and accurately drive an antenna such as a primary radiator, and an antenna device using the method.

Solution to Problem

In order to solve the above-described problem, the invention of a method for designing a gradient index lens with a planar focal plane includes: setting a virtual domain a boundary of which includes a curved focal plane in a uniform-refractive-index type lens with a uniform refractive index, and a physical domain a boundary of which includes a planar focal plane in a gradient index lens with a non-uniform refractive index and that is a quasiconformal map of the virtual domain; calculating, as a physical medium parameter in the physical domain, the quasiconformal map of a virtual medium parameter wherein the virtual medium parameter is a medium parameter including at least one of a dielectric constant and magnetic permeability characterizing the virtual domain; and designing the gradient index lens based on the physical medium parameter by spatially arranging a medium parameter adjustment element set in advance.

Further, the invention of an antenna device transmitting or receiving an electromagnetic wave by refracting the electromagnetic wave includes: the above-described gradient index lens; an antenna performing at least one of transmission and reception of an electromagnetic wave; and a direction setting mechanism regulating a transmission direction or a reception direction of an electromagnetic wave.

Advantageous Effects of Invention

According to the present invention, since the gradient index lens with a planar plate-shaped focal plane is set as the quasiconformal map of the uniform-refractive-index type lens with a curved plate-shaped focal plane, an antenna beam can be controlled by simple control of only changing a position of an antenna.

DESCRIPTION OF EMBODIMENTS

First Example Embodiment

Figure 1:
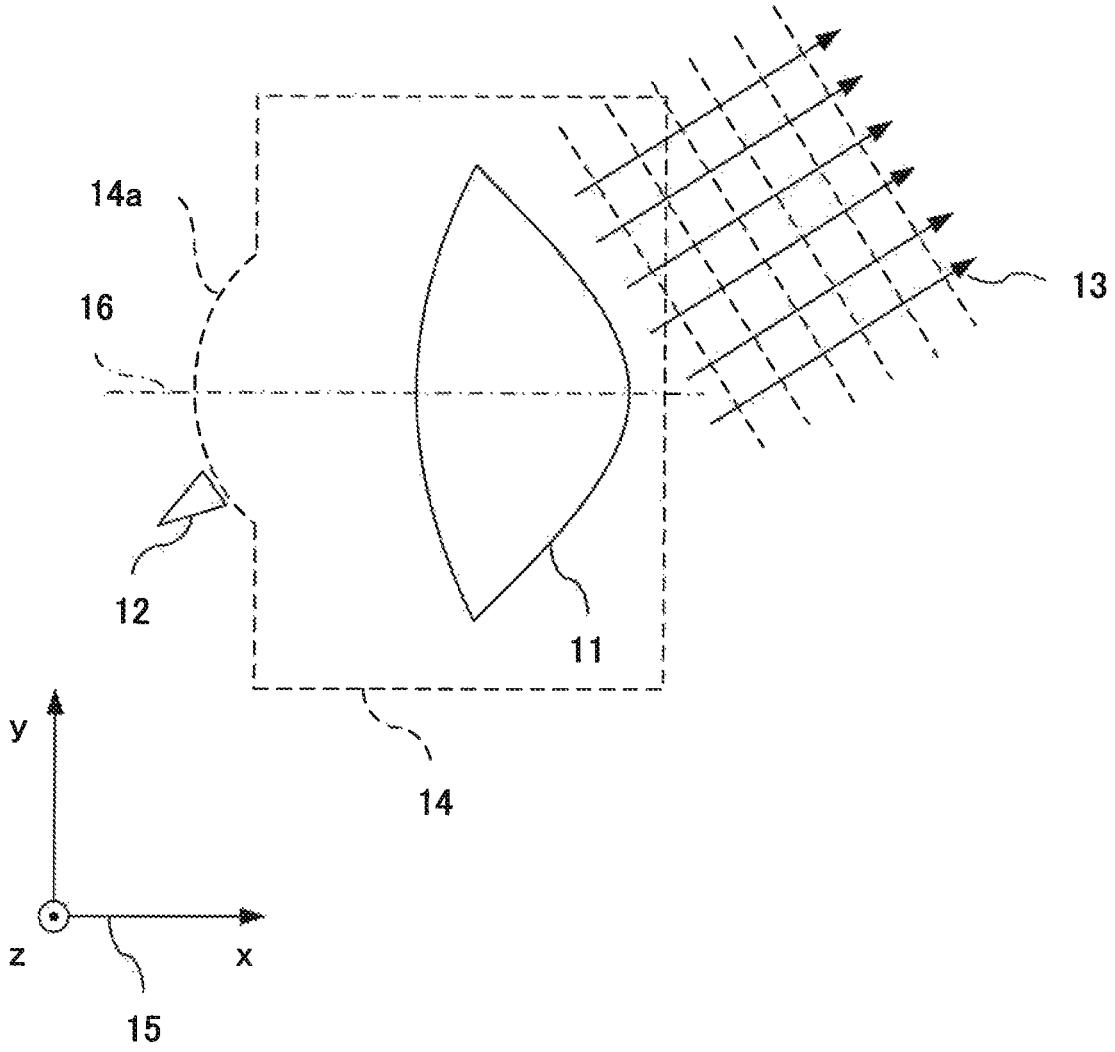
FIG. 1 is a side view of a virtual domain including a uniform-refractive-index type lens according to a first example embodiment.

A first example embodiment of the present invention is described. FIG. 1 is a side view of a virtual domain 14 including a uniform-refractive-index type lens 11. This uniform-refractive-index type lens 11 possesses a curved focal plane 14*a*, and an electromagnetic wave is radiated from an antenna 12 arranged so as to face the focal plane 14*a*. In the following, for purpose of convenience, the curved focal plane is written as a curved plate-shaped focal plane, and a planar focal plane is written as a planar plate-shaped focal plane to distinguish whether or not the focal plane is a curved plane or a planar plane.

An electromagnetic wave emitted from the antenna 12 is made incident on the uniform-refractive-index type lens 11, and is refracted and emitted. The electromagnetic wave emitted from the uniform-refractive-index type lens 11 is radiated as a beam 13 in a direction depending on a position of the antenna 12.

Figure 5:
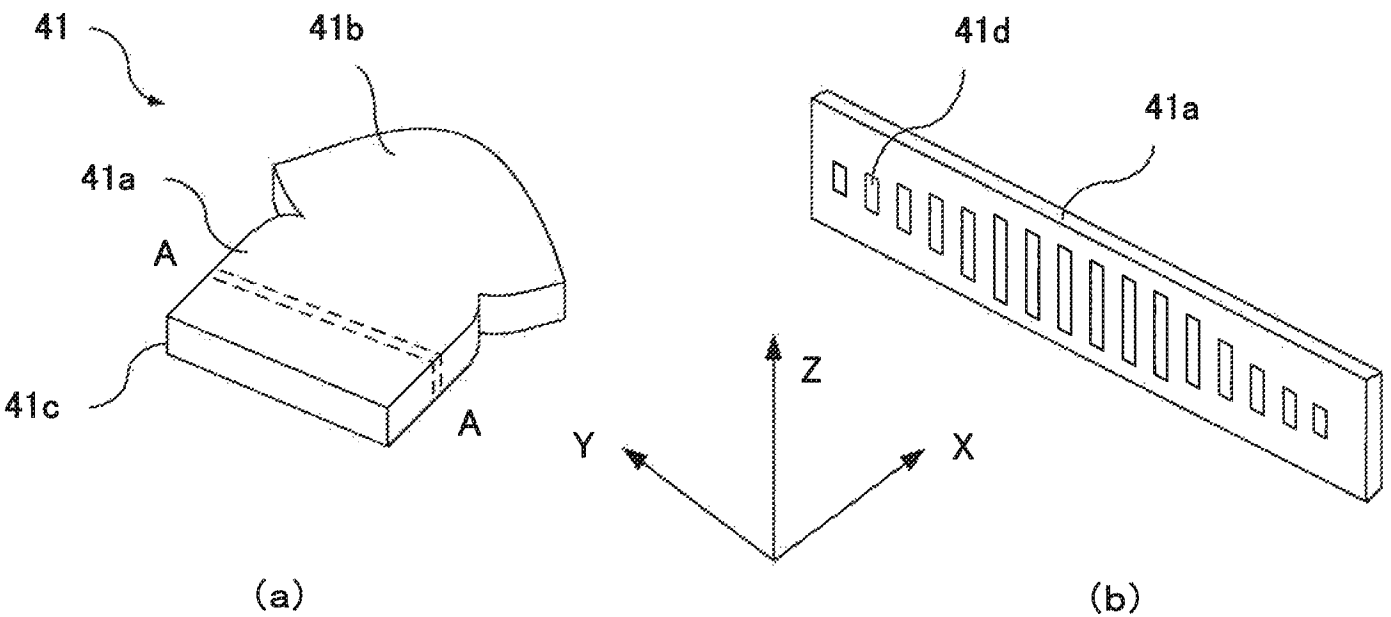
FIG. 5 is a diagram illustrating a two-dimensional gradient index lens, (a) is a perspective view of the gradient index lens, and (b) is a perspective view of an incident-side lens portion in (a).

Note that the uniform-refractive-index type lens 11 and a curved plate-shaped focal plane 14*a* may be either two-dimensionally shaped or three-dimensionally shaped. However, the uniform-refractive-index type lens 11 needs to be line-symmetrical with respect to an optical axis 16 when in the two-dimensional shape, and needs to be rotationally symmetrical with respect to the optical axis 16 when in the three-dimensional shape. Here, the two-dimensional shape is exemplified by a shape having a uniform thickness, as illustrated in FIG. 5(*a*), for example.

Moving the antenna 12 along the curved plate-shaped focal plane 14*a* causes a direction of the beam 13 to change depending on a position of the antenna 12. In other words, an elevation direction and an azimuth direction of the beam 13 can be controlled depending on a position of the antenna 12.

Incidentally, since the curved plate-shaped focal plane 14*a* is a curved plane, a drive mechanism for driving the antenna 12 along the curved plane is needed, and a configuration of this mechanism becomes very complicated.

An electromagnetic wave follows Maxwell's equations. Maxwell's equations include magnetic permeability and a dielectric constant representing properties of a field (a medium) where an electromagnetic wave is propagated. In other words, a propagation route of an electromagnetic wave varies depending on magnetic permeability and the dielectric constant.

A refractive index of the uniform-refractive-index type lens 11 illustrated in FIG. 1 is uniform (there is no space dependency of a refractive index). Accordingly, when a refractive index of a lens is not uniform, a shape of the focal plane is a shape different from the curved plate-shaped focal plane illustrated in FIG. 1. Therefore, a lens having a refractive index distribution that makes the focal plane planar is designed.

Figure 2:
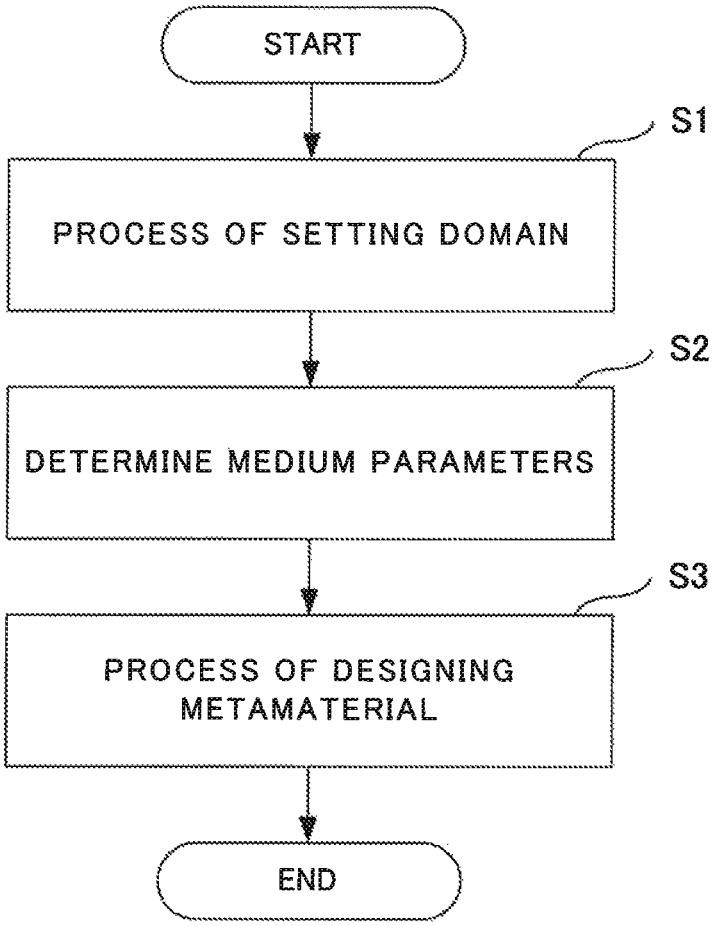
FIG. 2 is a flowchart illustrating a procedure for designing the gradient index lens.

It is assumed that a gradient index lens with a planar focal plane is acquired by performing mapping transformation on the uniform-refractive-index type lens 11 with the curved focal plane illustrated in FIG. 1. Specifically, it is assumed that the gradient index lens is acquired by performing mapping transformation on the shape characterizing the uniform-refractive-index type lens 11, and the magnetic permeability and the dielectric constant defining a propagation property of an electromagnetic wave. In the following, the description is made with reference to a flowchart of a procedure of designing the gradient index lens, illustrated in FIG. 2

Step S1: (a Process of Setting a Domain)

Now, a space (a virtual domain) 14 that includes the uniform-refractive-index type lens 11 as illustrated in FIG. 1, and the boundary of which forms a part of the curved plate-shaped focal plane 14*a* is supposed. Then, it is supposed that the uniform-refractive-index type lens 11 with the curved plate-shaped focal plane 14*a* in the virtual domain 14 is mapping-transformed into the gradient index lens with the planar plate-shaped focal plane. Here, the virtual domain on which the mapping-transformation has been performed is referred to as a physical domain. The magnetic permeability and the dielectric constant is collectively written as medium parameters, the medium parameters in the virtual domain are collectively written as virtual medium parameters, and the medium parameters in the physical domain are collectively written as physical medium parameters.

Figure 3:
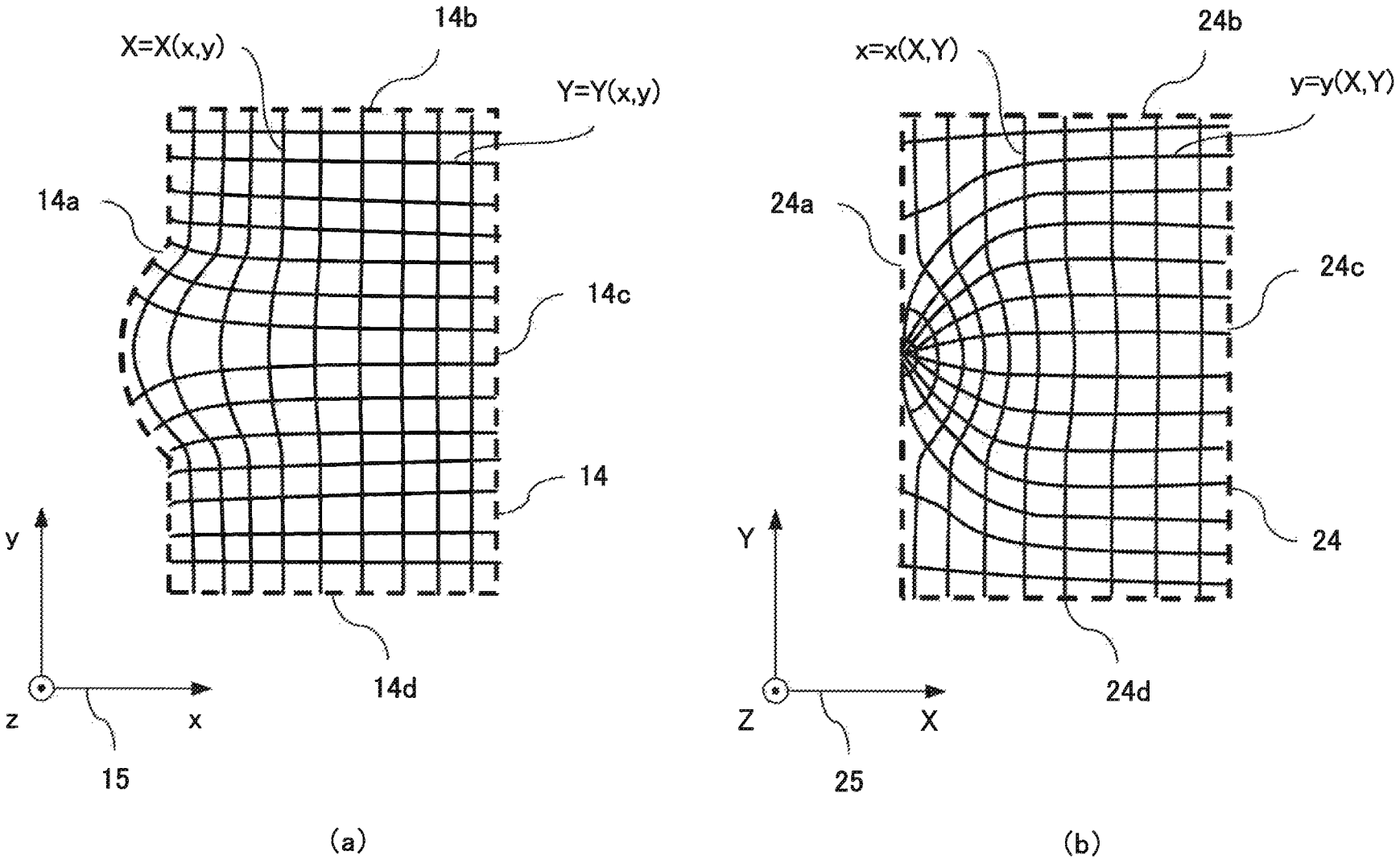
FIG. 3 is a diagram illustrating domains, (a) is a diagram exemplifying the virtual domain a boundary of which includes a curved plate-shaped focal plane, and (b) is a diagram exemplifying the physical domain a boundary of which includes a planar plate-shaped focal plane.

This matter is described with reference to FIG. 3. FIG. 3 is a diagram for describing the domains, (a) exemplifies the virtual domain 14 the boundary of which includes the curved plate-shaped focal plane 14*a*, and (b) exemplifies the physical domain 24 the boundary of which includes the planar plate-shaped focal plane 24*a*.

Step S2: (Determination of Medium Parameters)

An orthogonal coordinate system x-y-z (written as a virtual coordinate system in the following) representing the virtual domain 14, and an orthogonal coordinate system X-Y-Z (written as a physical coordinate system in the following) representing the physical domain are supposed.

Here, the virtual coordinate system and the physical coordinate system satisfy the relation of the equation 1.

[Equation 1]

$$X=X(x,y,z)$$

$$Y=Y(x,y,z)$$

$$Z=Z(x,y,z) \quad (1)$$

The Jacobian matrix which is a coordinate transform matrix can be expressed by the equation 2.

[Equation 2]

$$A = \begin{pmatrix} \frac{\partial X}{\partial x} & \frac{\partial X}{\partial y} & \frac{\partial X}{\partial z} \\ \frac{\partial Y}{\partial x} & \frac{\partial Y}{\partial y} & \frac{\partial Y}{\partial z} \\ \frac{\partial Z}{\partial x} & \frac{\partial Z}{\partial y} & \frac{\partial Z}{\partial z} \end{pmatrix} \quad (2)$$

When this Jacobian matrix is used, the virtual medium parameters (a dielectric constant $\varepsilon_1$ and magnetic permeability $\mu_i$) in the virtual domain 14, and the physical medium parameters (a dielectric constant $\varepsilon_2$ and magnetic permeability $\mu_2$) in the physical domain satisfy the equation 3.

[Equation 3]

$$\varepsilon_2 = \frac{A\varepsilon_1 A^T}{|A|} \quad (3)$$

$$\mu_2 = \frac{A\mu_1 A^T}{|A|}$$

Although the equation 1 and so on are relation equations required for general mapping, quasiconformal mapping needs to be performed as mapping from the virtual domain 14 formed by a non-quadrilateral region to the physical domain 24 formed by a quadrilateral region. In the following, the description is made by separating the case of the two-dimensional domain and the case of the three-dimensional domain.

<In the Case of the Two-Dimensional Domain>

When a domain is two-dimensional, there is no mapping between the z-axis in the virtual coordinate system and the Z-axis in the physical coordinate system. For this reason, the equation 1 can be expressed by the equation 4.

[Equation 4]

$$X=X(x,y)$$

$$Y=Y(x,y)$$

$$Z=z \quad (4)$$

Here, in the virtual domain 14, the Laplace equation concerning X and Y components expressed by the equation 5 is solved. Provided that when a solution of the equation 5 is sought, the following Dirichlet boundary condition and Neumann boundary condition are applied.

[Equation 5]

$$\frac{\partial^2 X}{\partial x^2} + \frac{\partial^2 X}{\partial y^2} = 0 \quad (5)$$

$$\frac{\partial^2 Y}{\partial x^2} + \frac{\partial^2 Y}{\partial y^2} = 0$$

The Dirichlet boundary condition: It is assumed that concerning an X component, the curved plate-shaped focal plane 14*a* that is the boundary of the virtual domain 14 is mapped to the planar plate-shaped focal plane 24*a* that is the boundary of the physical domain 24. Further, it is assumed that the boundary 14*c* of the virtual domain 14 is mapped to the boundary 24*c* of the physical domain 24. Furthermore, it is assumed that concerning a Y component, the boundary 14*b* is mapped to the boundary 24*b*, and the boundary 14*d* is mapped to the boundary 24*d*.

The Neumann boundary condition: It is assumed that when a normal vector at the boundary is a vector S, an X component satisfies the condition (the Neumann boundary condition) expressed by the equation 6, at the boundary 14*b* and the boundary 14*d*. Similarly, it is assumed that a Y component satisfies the equation 6 at the boundary 14*a* and the boundary 14*c*.

[Equation 6]

$$\frac{\partial K_i}{\partial \vec{S}} = 0 \quad K_i = \begin{cases} X & \text{for } i = 1 \\ Y & \text{for } i = 2 \end{cases} \quad (6)$$

A solution of the equation 5 can be illustrated as contour lines of coordinates in the virtual domain 14 and the physical domain 24. In the virtual domain 14 illustrated in FIG. 3(*a*), the contour lines concerning X(x, y) and Y(x, y) components depending on two variables that are x and y components can be exemplified. Further, in the physical domain 24 in FIG. 3(*b*), the contour lines concerning x(X, Y) and y(X, Y) components depending on two variables that are X and Y components can be exemplified.

When the solution of the equation 5 is thus acquired, $(AA^T)/|A|$ is given by the equation 7.

[Equation 7]

$$\frac{AA^T}{|A|} = \begin{pmatrix} M^{-1} & 0 & 0 \\ 0 & M & 0 \\ 0 & 0 & |A|^{-1} \end{pmatrix} \quad (7)$$

Provided that in the equation 7, M is a real number defined by the equation 8.

[Equation 8]

$$M = \frac{\partial Y}{\partial y} \Big/ \frac{\partial X}{\partial x} \quad (8)$$

Further, for the antenna 12, a component in an out-of-plane direction with respect to the two-dimensional plane is restricted. Thereby, one of the physical medium parameters (the magnetic permeability and the dielectric constant) in the equation 3 can be 1. In other words, when in a transverse electric (TE) mode where an electric field component exists in the out-of-plane direction, the magnetic permeability can be regarded as 1, and when in a transverse magnetic (TM) mode where a magnetic field component exists in the out-of-plane direction, the dielectric constant can be regarded as 1.

For this reason, depending on a mode of the antenna 12, a medium forming the physical domain 24, i.e., the gradient index lens can be implemented by a dielectric substance alone or a magnetic substance alone.

Further, concerning the equation 7, as long as no singular point is given in the quasiconformal map, the first diagonal component and the second diagonal component can be regarded as almost 1, respectively.

For this reason, the equation 3 finally becomes a simple equation in which the third diagonal component is expressed by the determinant |A| of the Jacobian matrix in the equation 2, as expressed in the equation 9.

[Equation 9]

$$\varepsilon_2 \approx \varepsilon_1 \mathrm{Diag}[1,1|A|^{-1}]$$

$$\mu_2 \approx \mu_1 \mathrm{Diag}[1,1|A|^{-1}] \quad (9)$$

Figure 4:
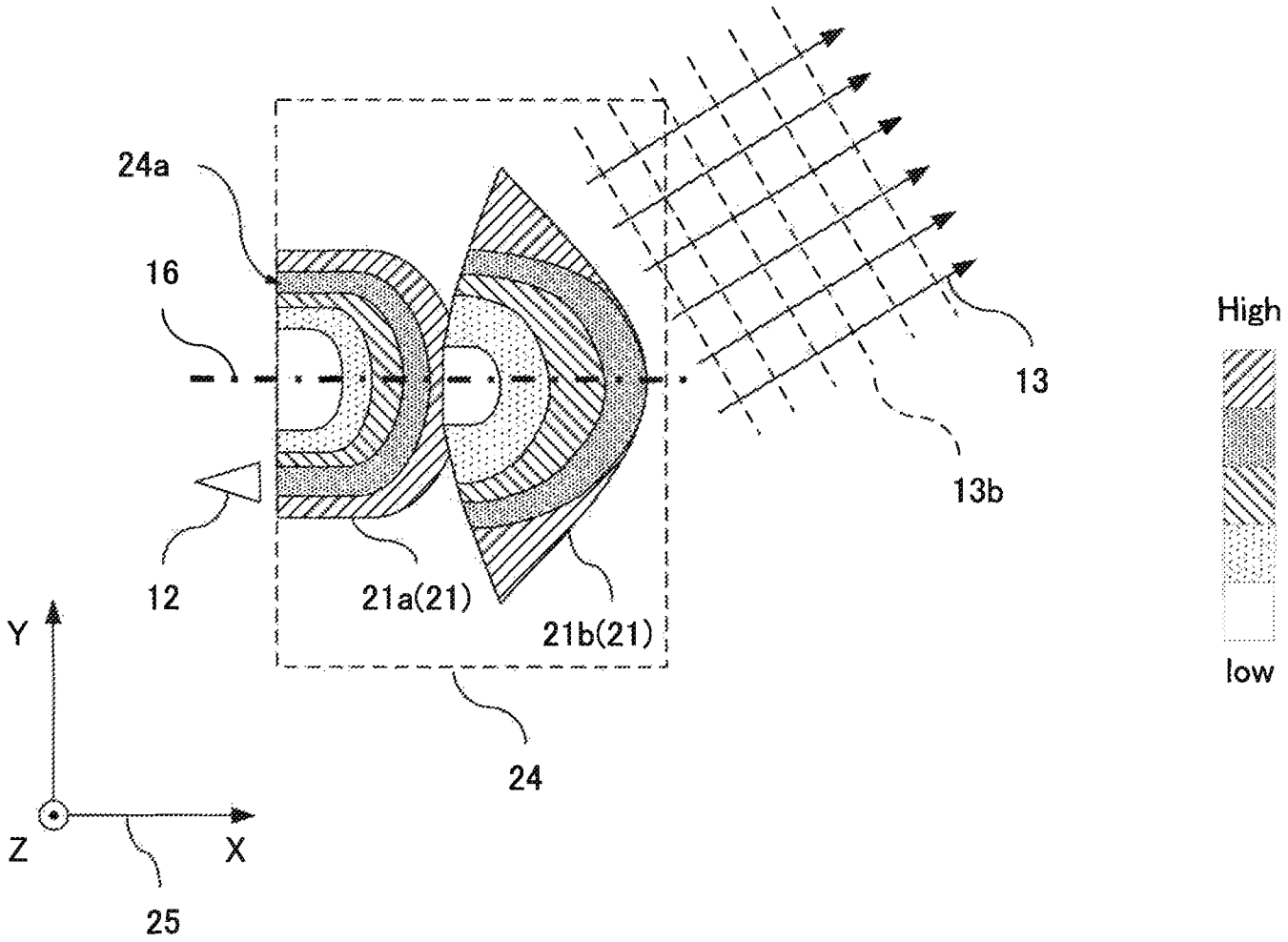
FIG. 4 is a diagram exemplifying a refractive index distribution in the physical domain acquired by performing quasiconformal mapping on the virtual domain.

FIG. 4 is a diagram exemplifying a refractive index distribution in the physical domain 24 acquired by performing the quasiconformal mapping on the virtual domain 14 illustrated in FIG. 1. The gradient index lens 21 can be separated into an element (written as an incident-side lens portion 21*a* in the following) on the side of the planar plate-shaped focal plane 24*a*, and an element (written as an emitting-side lens portion 21*b* in the following) on the side of the beam 13.

The incident-side lens portion 21*a* corresponds to a lens (in fact, a spatial distribution of the medium parameters) acquired by performing the quasiconformal mapping on a domain (a lens-to-focal-plane domain) between the curved plate-shaped focal plane 14*a* and the uniform-refractive-index type lens 11 in FIG. 1. The emitting-side lens portion 21*b* corresponds to a lens (a spatial distribution of the medium parameters) acquired by performing the quasiconformal mapping on a lens domain, with the uniform-refractive-index type lens 11 being the lens domain. Note that when a refractive index becomes 1 or less by the equation 7, influence on a wave plane 13 is small, and for this reason, the removal is made here. In other words, it is assumed that values of the physical medium parameters affecting an electromagnetic wave in such a way that a refractive index becomes smaller than 1 do not constitute the physical medium parameters.

Thus, the physical domain 24 in FIG. 4 is acquired by performing the quasiconformal mapping on the virtual domain 14, and when, for instance, the TE mode is selected for the antenna 12, the gradient index lens can be implemented by a dielectric substance alone. In this case, a refractive index distribution n is given by the equation 10.

[Equation 10]

$$n=\sqrt{\varepsilon_2} \quad (10)$$

Here, the gradient index lens 21 is line-symmetrical with respect to the optical axis 16. As long as the equation 9 is satisfied, a restriction is not imposed on a thickness of the gradient index lens 21 in the Z-axis direction. In other words, the two-dimensional gradient index lens 21 with the planar plate-shaped focal plane 24*a* is acquired.

<In the Case of a Three-Dimensional Domain>

Next, when a domain is three-dimensional is described. In this case, the quasiconformal mapping is expanded in such a way that the two-dimensional gradient index lens 21 is made to be rotationally symmetrical with respect to the optical axis 16.

Here, lengths $\rho_1$ and $\rho_2$ are defined by the equation 11.

[Equation 11]

$$\rho_1=\sqrt{y^2+z^2}$$

$$\rho_2=\sqrt{Y^2+Z^2} \quad (11)$$

At this time, a dielectric constant $\varepsilon_2$ and magnetic permeability $\mu_2$ of the three-dimensional gradient index lens is given by the equation 12.

[Equation 12]

$$\varepsilon_2 = \mathrm{Diag}[\varepsilon_{2\rho_1}, \varepsilon_{2\phi}, \varepsilon_{2z}] = \varepsilon_1 \mathrm{Diag}\left[\left(\frac{\rho_1}{\rho_2}\right)^2, \frac{1}{|A_c|}, \left(\frac{\rho_1}{\rho_2}\right)^2\right] \quad (12)$$

$$\mu_2 = \mathrm{Diag}[\mu_{2\rho_1}, \mu_{2\phi}, \mu_{2z}] = \mu_1 \mathrm{Diag}\left[1, \left(\frac{\rho_2}{\rho_1}\right)^2 \frac{1}{|A_c|}, 1\right]$$

In the equation 12, $A_c$ is the Jacobian matrix given by the equation 13.

[Equation 13]

$$A_c = \begin{pmatrix} \frac{\partial \rho_2}{\partial \rho_1} & 0 & \frac{\partial \rho_2}{\partial x} \\ 0 & 1 & 0 \\ \frac{\partial X}{\partial \rho_1} & 0 & \frac{\partial X}{\partial x} \end{pmatrix} \quad (13)$$

Provided that in the equation 12, the magnetic permeability $\mu_2$ can be regarded as approximately 1 or less. As a result, the three-dimensional gradient index lens can be implemented by a dielectric substance alone. Note that although the refractive index distribution determined from the equation 12 is not illustrated, the respective matrix elements express the distribution similarly to FIG. 4.

Step S3: (a Process of Designing a Metamaterial)

Since the refractive index distribution in the physical domain is thus acquired, the gradient index lens with the refractive index distribution is embodied.

Strict uniformity is not required for a medium of the gradient index lens. In other words, the medium may be uniform at the level of being regarded as sufficiently uniform with respect to an operating wavelength of an electromagnetic wave. Generally, the medium concerned is referred to as a metamaterial. This metamaterial can be implemented by elements or the like (referred to as medium parameter adjustment elements in the following) such as dielectric substances, metals, or vacancies that are arranged with sizes at intervals, the sizes and the intervals being sufficiently short compared with the operating wavelength.

Figure 6:
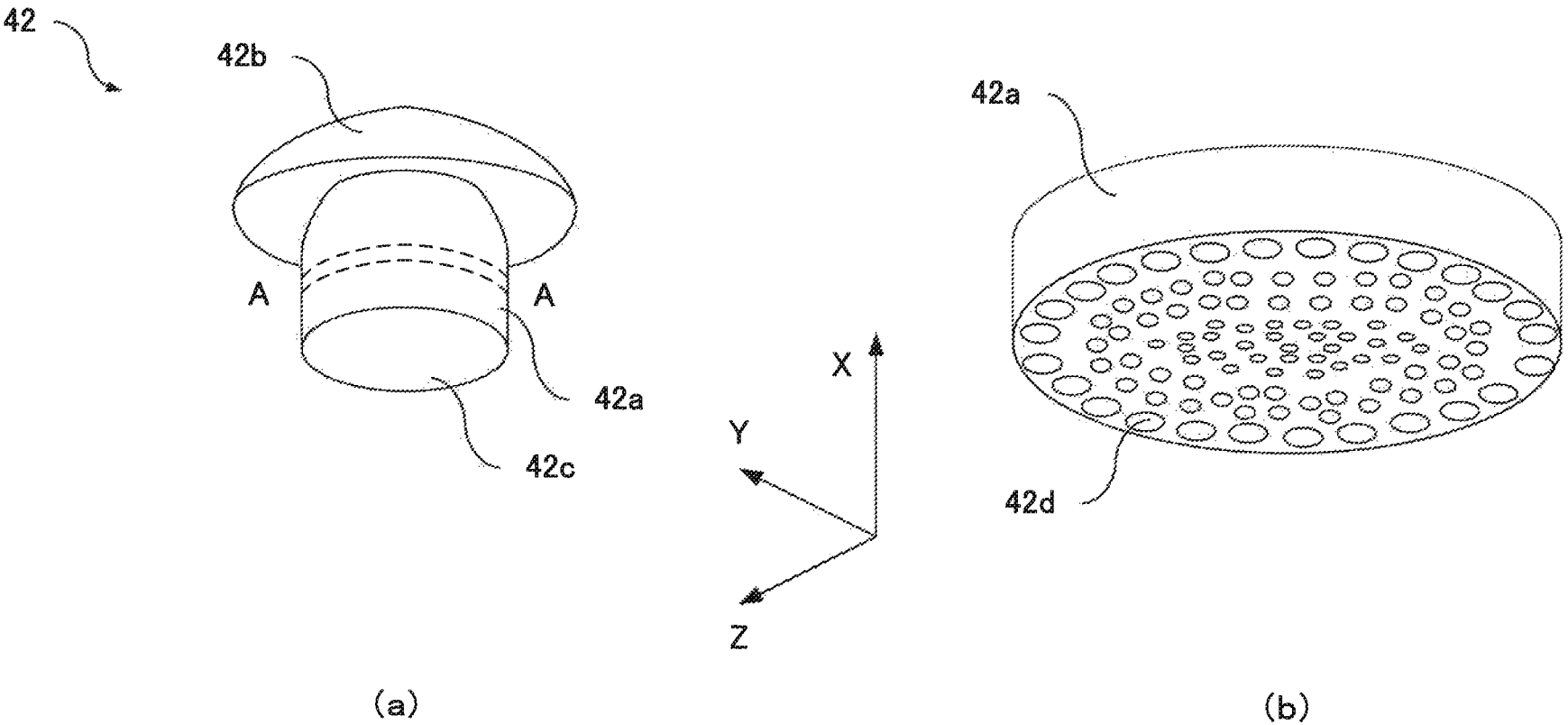
FIG. 6 is a diagram illustrating a three-dimensional gradient index lens, (a) is a perspective view of the gradient index lens, and (b) is a perspective view of an incident-side lens portion in (a).

The gradient index lens having the metamaterial as the medium is described. FIG. 5 is a diagram illustrating a two-dimensional gradient index lens 41, and FIG. 6 is a diagram illustrating a three-dimensional gradient index lens 42. The gradient index lens 41 and the gradient index lens 42 include incident-side lens portions 41*a* and 42*a*, emitting-side lens portions 41*b* and 42*b*, and planar plate-shaped focal planes 41*c* and 42*c*, respectively.

In FIG. 5 and FIG. 6, (a) is a perspective view of the gradient index lens 41 or 42, (b) is a perspective view of the incident-side lens portion (an area A) 41*a* or 42*a* in (a). Although in FIG. 5 and FIG. 6, the areas A are defined in the incident-side lens portions 41*a* and 42*a*, the similar definition is made in the emitting-side lens portions 41*b* and 42*b* as well. The areas A are written as slice portions in the following.

As illustrated in FIG. 5, in the case of the gradient index lens 41 of the two-dimensional structure, in the incident-side lens portion 41*a*, the medium parameter adjustment elements 41*d* such as a metal pattern are arranged. Depending on an arrangement state of the medium parameter adjustment elements 41*d*, a dielectric constant changes. In other words, depending on lengths of the medium parameter adjustment elements 41*d* such as a metal pattern, an effective dielectric constant of the incident-side lens portion 41*a* changes. For example, as lengths of the medium parameter adjustment elements 41*d* are longer, a dielectric constant becomes higher, and reversely, as lengths of the medium parameter adjustment element 41*d* are shorter, a dielectric constant becomes smaller.

In view of the above, when the gradient index lens 41 is two-dimensionally structured, a thickness (a thickness in the X-axis direction in FIG. 5(*b*)) of the slice portion is set as a size sufficiently smaller compared with a wavelength of an electromagnetic wave, and the slice portions each having this size are stacked in the X-axis direction. Thereby, the gradient index lens 41 having a desired refractive index distribution can be formed.

As illustrated in FIG. 6, in the gradient index lens 42 of the three-dimensional structure, the medium parameter adjustment elements 42*d* that include a plurality of columnar vacancies having different diameters are arranged in the incident-side lens portion 42*a*.

At this time, as diameters and lengths of the medium parameter adjustment element 42*d* are larger, an effective dielectric constant is smaller, and reversely, as diameters and lengths of the medium parameter adjustment element 42*d* are smaller, an effective dielectric constant is larger. Thereby, a refractive index distribution can be implemented.

The gradient index lens 42 of the three-dimensional structure is implemented by stacking such slice portions.

By the above, the designing of the gradient index lens with the planar focal plane (the planar plate-shaped focal plane) is completed.

Figure 7:
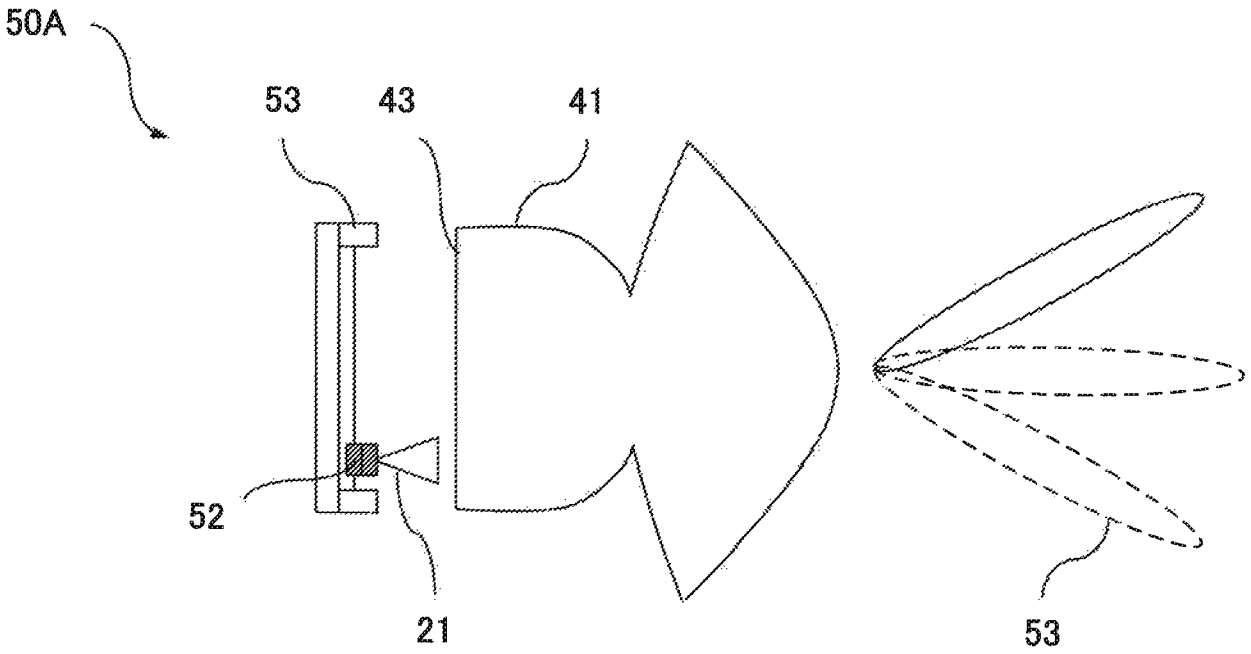
FIG. 7 is a side view of an antenna device driving an antenna arranged so as to face a planar plate-shaped focal plane of a gradient index lens.

Next, an antenna device including the antenna 12 driven along the planar plate-shaped focal plane is described. FIG. 7 is a side view of an antenna device 50A driving the antenna 12 arranged so as to face a planar plate-shaped focal plane 43 of the gradient index lens 41.

The antenna device 50A includes a direction setting mechanism constituted by a rotation drive unit 52 and a translational motion drive unit 53, and includes the gradient index lens 41 with the planar plate-shaped focal plane described above. The antenna 12 is attached to the rotation drive unit 52. By this rotation drive unit 52, the antenna 12 is rotated so that a direction of polarization of an electromagnetic wave radiated from the antenna 12 can be set.

Further, the translational motion drive unit 53 moves the antenna 12 along the planar plate-shaped focal plane 43. Thereby, an incident point when an electromagnetic wave radiated from the antenna 12 is made incident on the gradient index lens 41 changes. Then, the electromagnetic wave is refracted when passing through the gradient index lens 41, becomes a beam 53 depending on an incident condition and a refraction condition, and is radiated.

Note that when the gradient index lens 41 is two-dimensionally structured, the antenna device 50A is capable of translationally moving the antenna 12 in a one-dimensional direction, and when the gradient index lens 41 is three-dimensionally structured, the antenna device 50A is capable of translationally moving the antenna 12 in two-dimensional directions.

Figure 8:
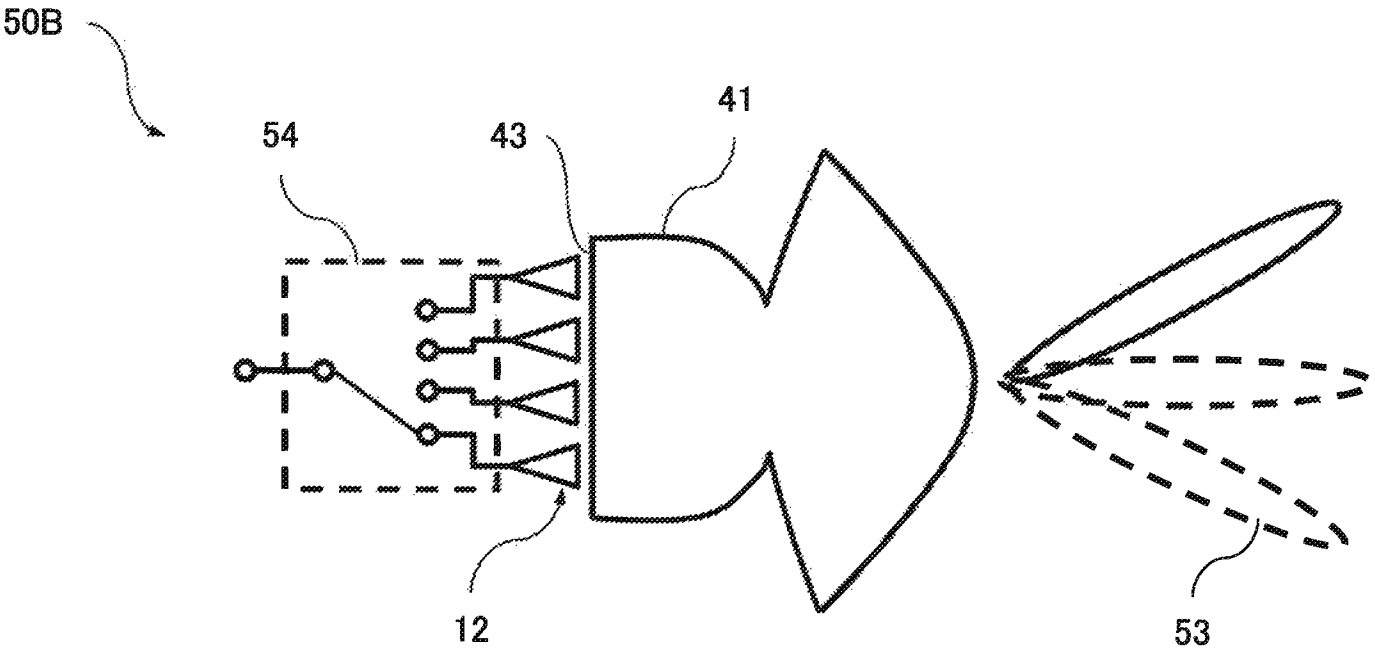
FIG. 8 is a side view of an antenna device selecting one antenna from a plurality of antennas.

Incidentally, a position of the antenna 12 is adjusted by the antenna device 50A. However, there is no limitation to such a configuration. As described above, depending on a position of the incident point when an electromagnetic wave is made incident on the focal plane, a direction of the beam changes. For this reason, when a plurality of the antennas 12 are provided, the antennas 12 do not need to be driven. FIG. 8 is a side view of an antenna device 50B selecting one antenna from a plurality of the antennas 12 configured from such a standpoint.

The antenna device 50B includes a plurality of the antennas 12 arranged so as to face the planar plate-shaped focal plane 43, and a selection unit 54 selecting one of the antennas 12. The antenna 12 is selected by the selection unit 54, and a beam 53 of a direction depending on a position of the selected antenna 12 is thereby emitted from the gradient index lens 41.

Since such a selection unit 54 can be configured by an electronic circuit, a direction of the beam 53 can be switched at a high speed compared with a mechanical configuration.

Figure 9:
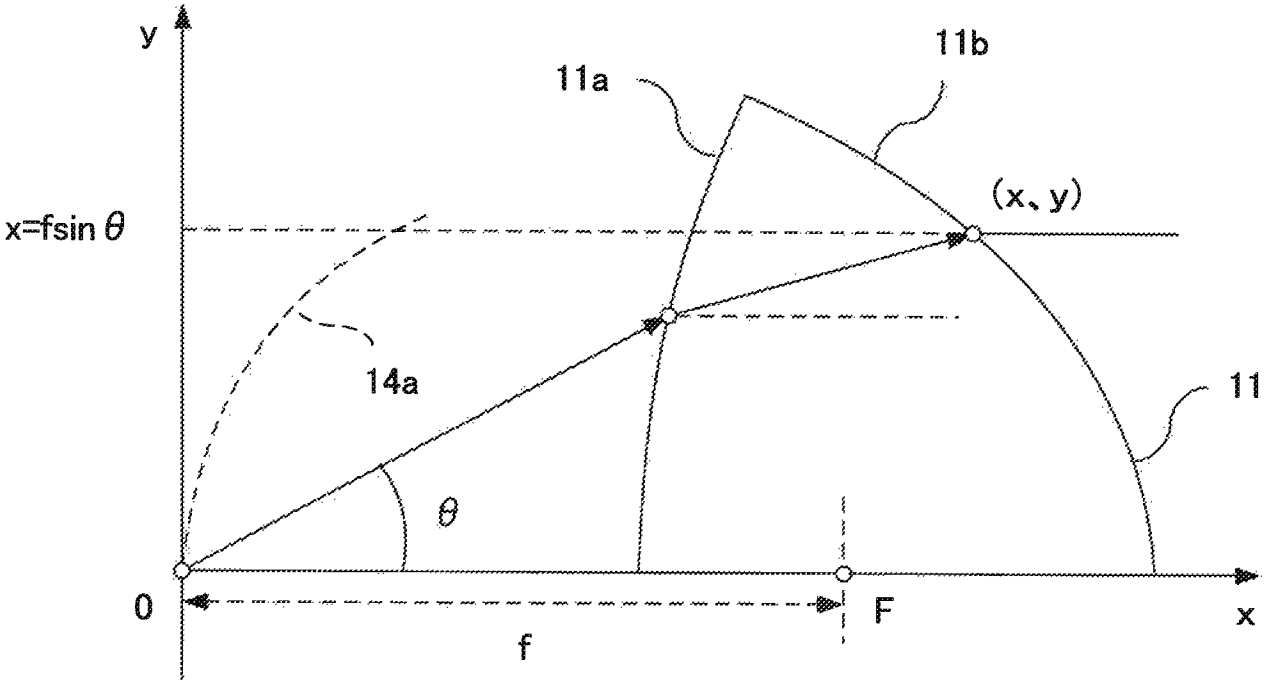
FIG. 9 is a diagram illustrating a shape of a uniform-refractive-index type lens that is the original of quasiconformal mapping.

Incidentally, the above description does not explicitly state specific conditions concerning a shape of the uniform-refractive-index type lens 11 that is the original of the quasiconformal mapping for the gradient index lens. However, a condition concerning a shape of the uniform-refractive-index type lens 11 can be imposed. With reference to FIG. 9, this condition is described. FIG. 9 is a diagram illustrating a shape of the uniform-refractive-index type lens 11 that is the original of the quasiconformal mapping.

It is assumed that, in the uniform-refractive-index type lens 11, a surface on the side of the curved plate-shaped focal plane 14*a* is a first surface 11*a*, and a surface on the side opposite to the first surface 11*a* is a second surface 11*b*. When a point where the optical axis 16 intersects with the curved plate-shaped focal plane 14*a* is the origin O, the equation 14 is established for a distance f from the origin O to the point F that is the center of the uniform-refractive-index type lens 11.

[Equation 14]

$$x = f \sin \theta \tag{14}$$

This relational expression is referred to as Abbe's sine rule, and is a condition for suppressing coma aberration when the antenna 12 of the uniform-refractive-index type lens 11 is moved on the curved plate-shaped focal plane 14*a*. By setting a shape of the uniform-refractive-index type lens 11 so as to satisfy such a relational expression, it is possible to reduce deterioration of a beam gain when a beam is formed in a direction shifting to a wide angle from the optical axis (the x axis in FIG. 9).

In this condition, the curved plate-shaped focal plane 14*a* is positioned on a circle or a sphere of a radius f centering the point F. The gradient index lens can be implemented by the quasiconformal map of the uniform-refractive-index type lens 11 that satisfies Abbe's sine rule.

Second Example Embodiment

Next, a second example embodiment of the present invention is described. Note that concerning the same configuration as that of the first example embodiment, the same reference symbols are used, and the description is appropriately omitted.

In the first example embodiment, the virtual domain 14 the boundary of which contacts with the focal plane and that includes the uniform-refractive-index type lens 11 is supposed. In the present example embodiment, as illustrated in FIG. 10, a virtual domain 14 the boundary of which contacts with the focal plane but that does not include the uniform-refractive-index type lens 11 is supposed.

Figure 10:
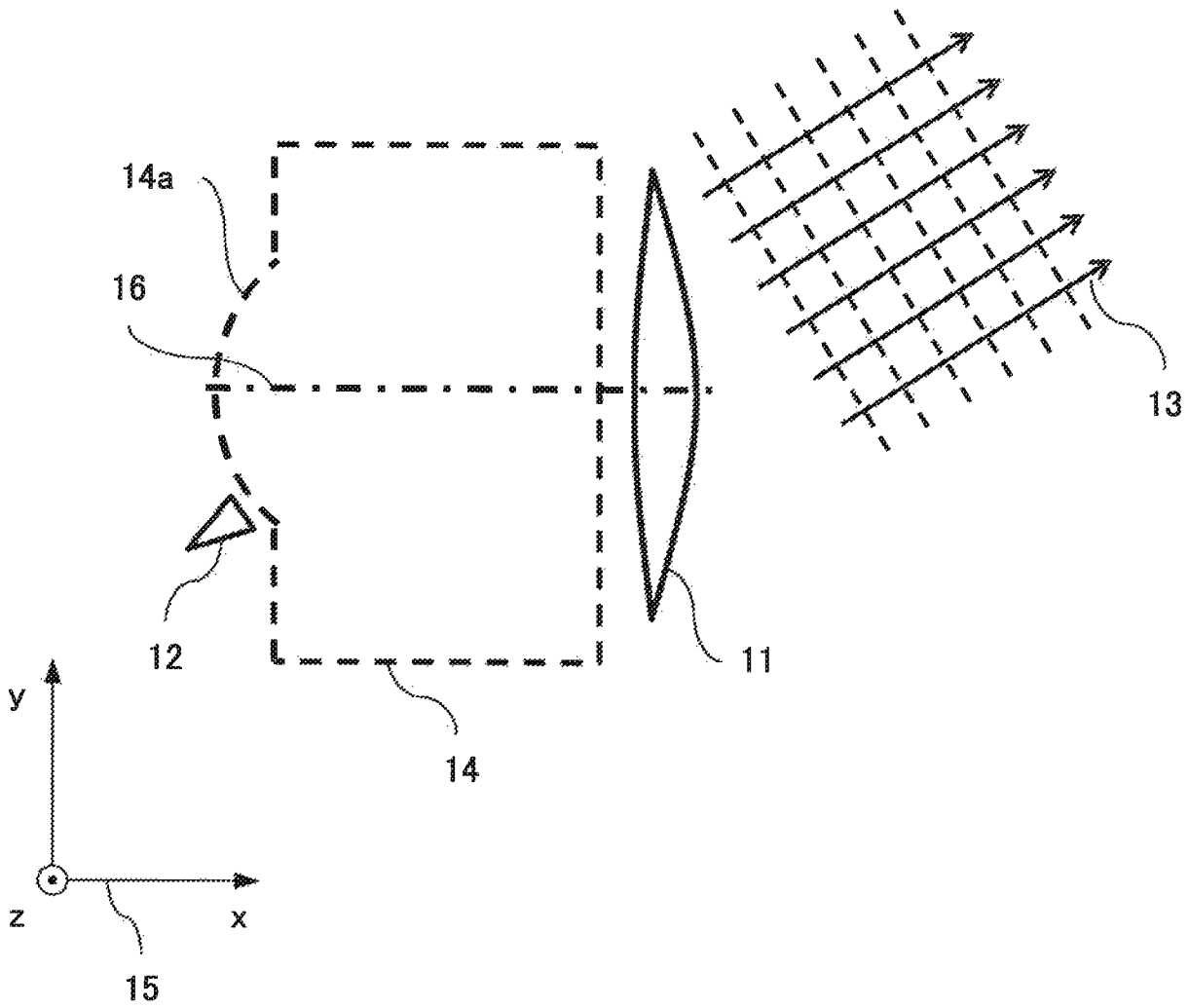
FIG. 10 is a side view of a virtual domain not including a uniform-refractive-index type lens according to a second example embodiment.

FIG. 10 is a side view of the virtual domain that does not include the uniform-refractive-index type lens 11 according to the second example embodiment.

Figure 11:
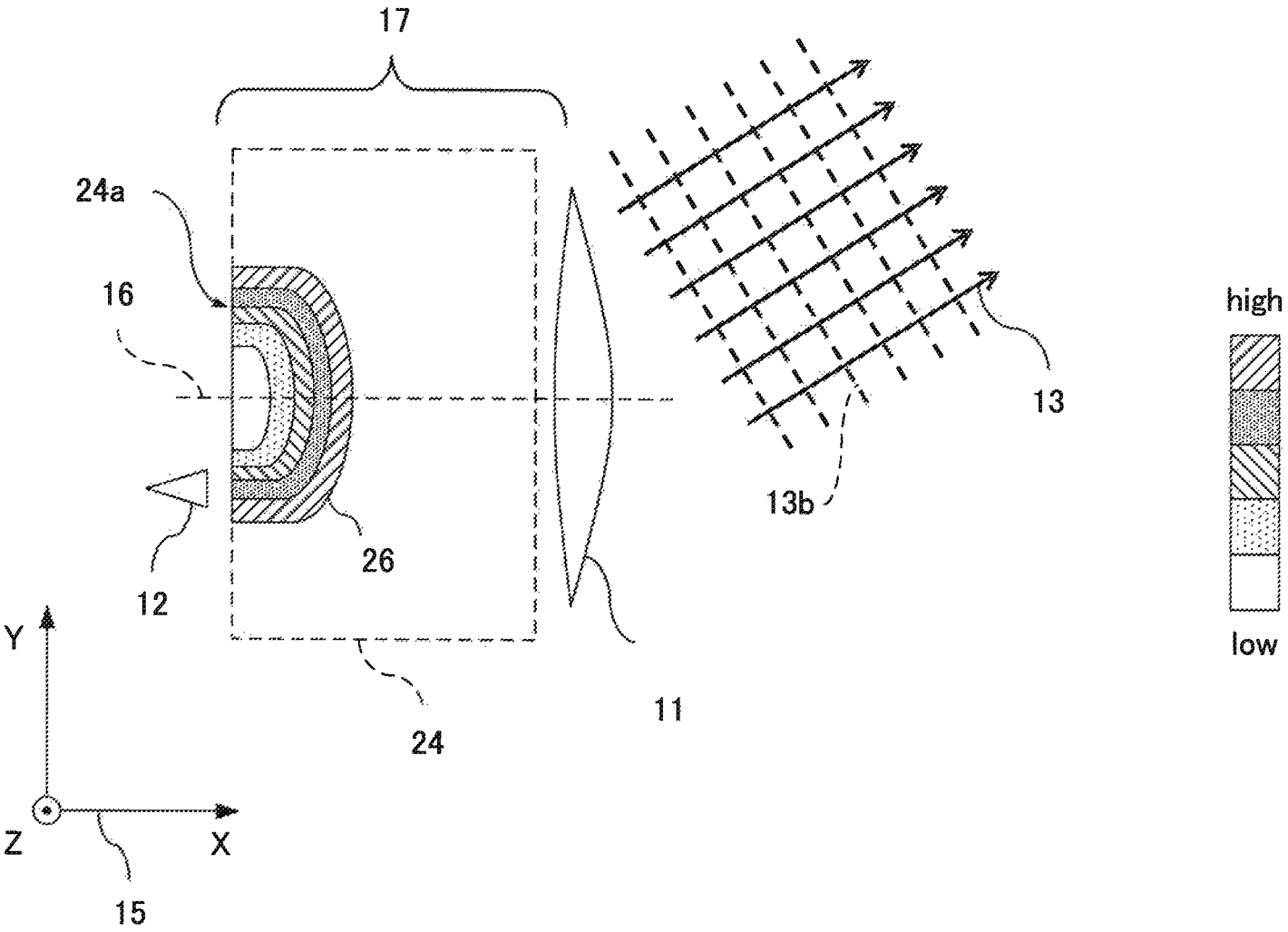
FIG. 11 is a side view of a physical domain acquired by performing quasiconformal mapping on the virtual domain.

Then, mapping of this virtual domain 14 to a physical domain 24 as illustrated in FIG. 11 is considered. Note that FIG. 11 is a side view of a physical domain acquired by the quasiconformal mapping of the virtual domain. It is assumed that at this time, a distance between the uniform-refractive-index type lens 11 and a curved plate-shaped focal plane 14*a* is sufficiently long, and the virtual domain 14 is limited to a free space that does not include the uniform-refractive-index type lens 11 and the boundary of which includes the curved plate-shaped focal plane 14*a*. Then, the map of the free space is acquired.

By performing the quasiconformal mapping on the virtual domain 14 to a physical domain 24 with four sides being flat as illustrated in FIG. 11, a gradient index sub-lens 26 is formed due to compression of the curved plate-shaped focal plane 14*a*. In other words, by being mapping-transformed, virtual medium parameters of the free space act like a lens to an area that is not mapping-transformed (including the case where a degree of mapping-transformation is small). When image-like description is stated, the free space is mapping-transformed, resulting in being like a heat haze in midsummer.

Needless to say, virtual medium parameters of the uniform-refractive-index type lens 11 existing outside the range of the quasiconformal mapping are not changed.

Accordingly, an electromagnetic wave radiated from the antenna 12 is refracted by the gradient index sub-lens 26 and the uniform-refractive-index type lens 11. In other words, the gradient index sub-lens 26 and the uniform-refractive-index type lens 11 work as a complex lens 17 that exercises a function similar to that of the gradient index lens 21 described in the first example embodiment. In this case, a focal plane of the complex lens 17 is a planar plate-shaped focal plane 24*a*.

Note that when the free space is air, a vacuum, or the like, it is difficult to make a configuration so as to satisfy physical medium parameters by medium parameter adjustment elements. However, this free space can be implemented by setting the free space as a metamaterial medium constituted by a multipurpose dielectric-substance material such as a resin, or a liquid including mixed metal particles with particle sizes smaller than a wavelength of an electromagnetic wave.

Thereby, it can be expected to reduce a weight and a loss of the entire lens, and manufacturing cost.

Figure 12:
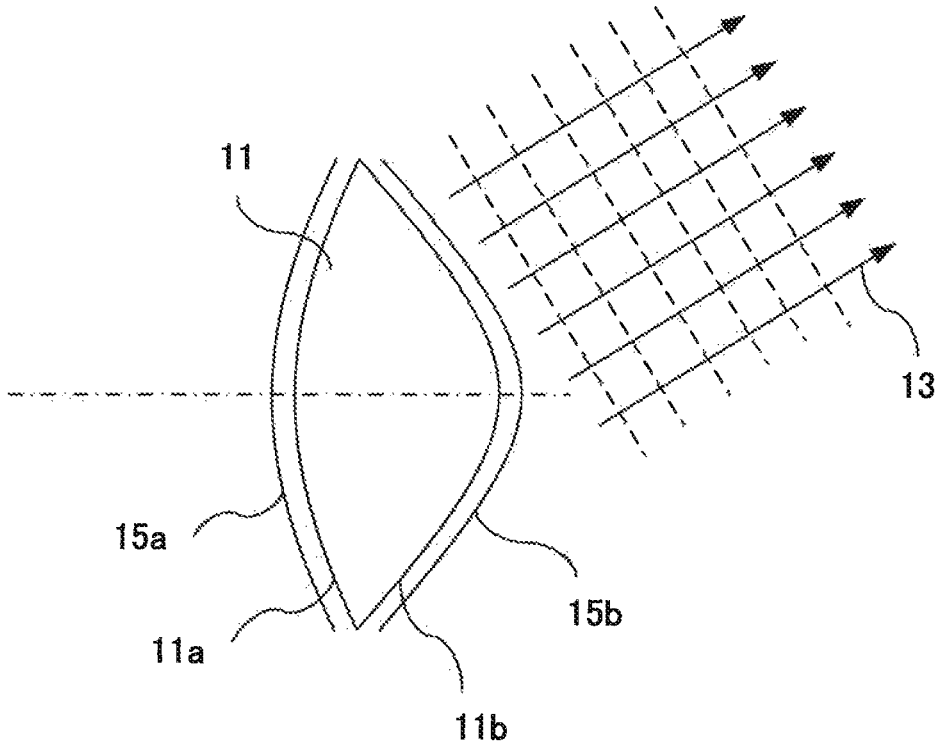
FIG. 12 is a schematic diagram illustrating a first matching layer and a second matching layer provided at a uniform-refractive-index type lens.
Figure 13:
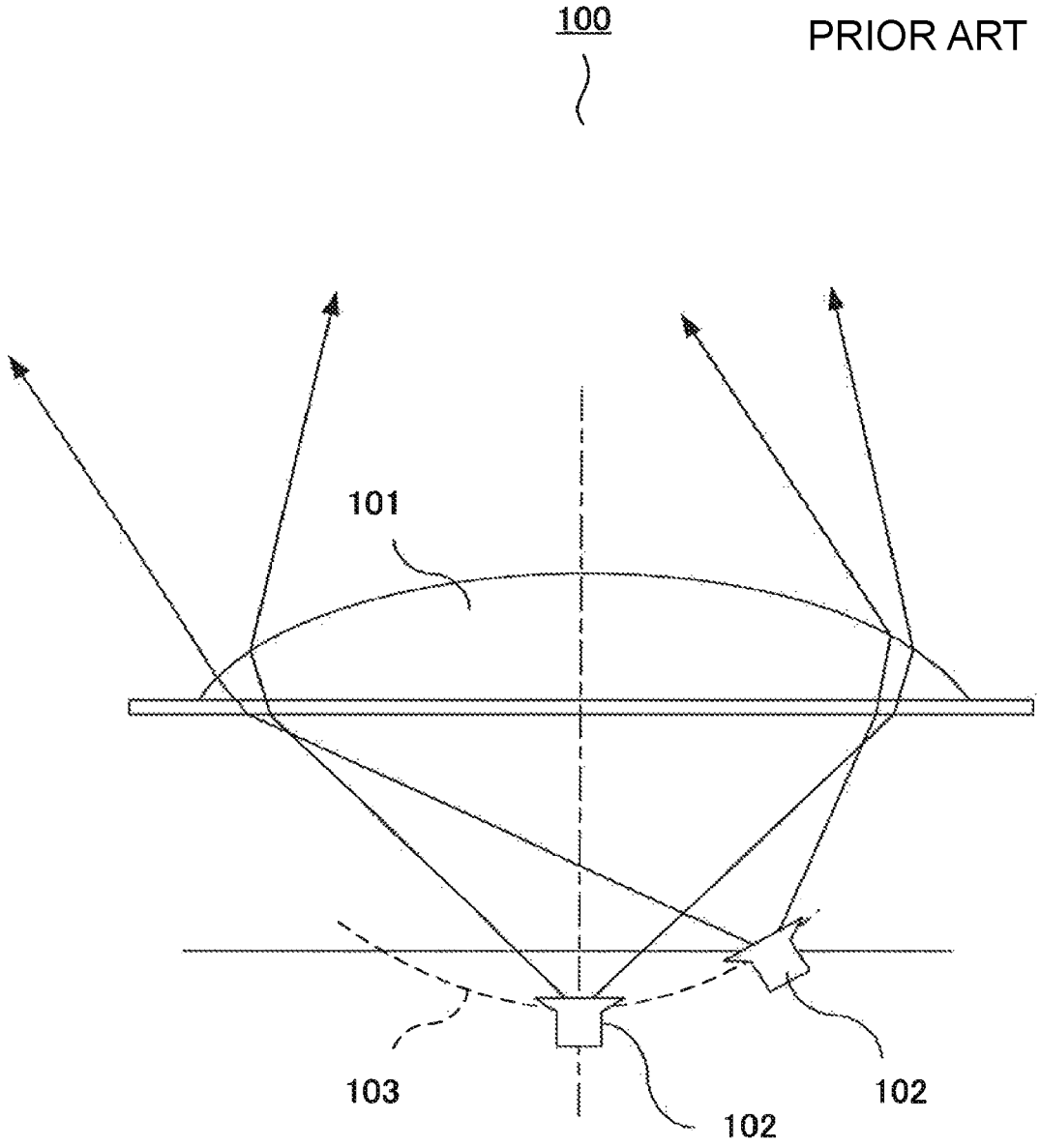
FIG. 13 is a diagram illustrating a configuration of an antenna device cited in the description of the related art.
Figure 14:
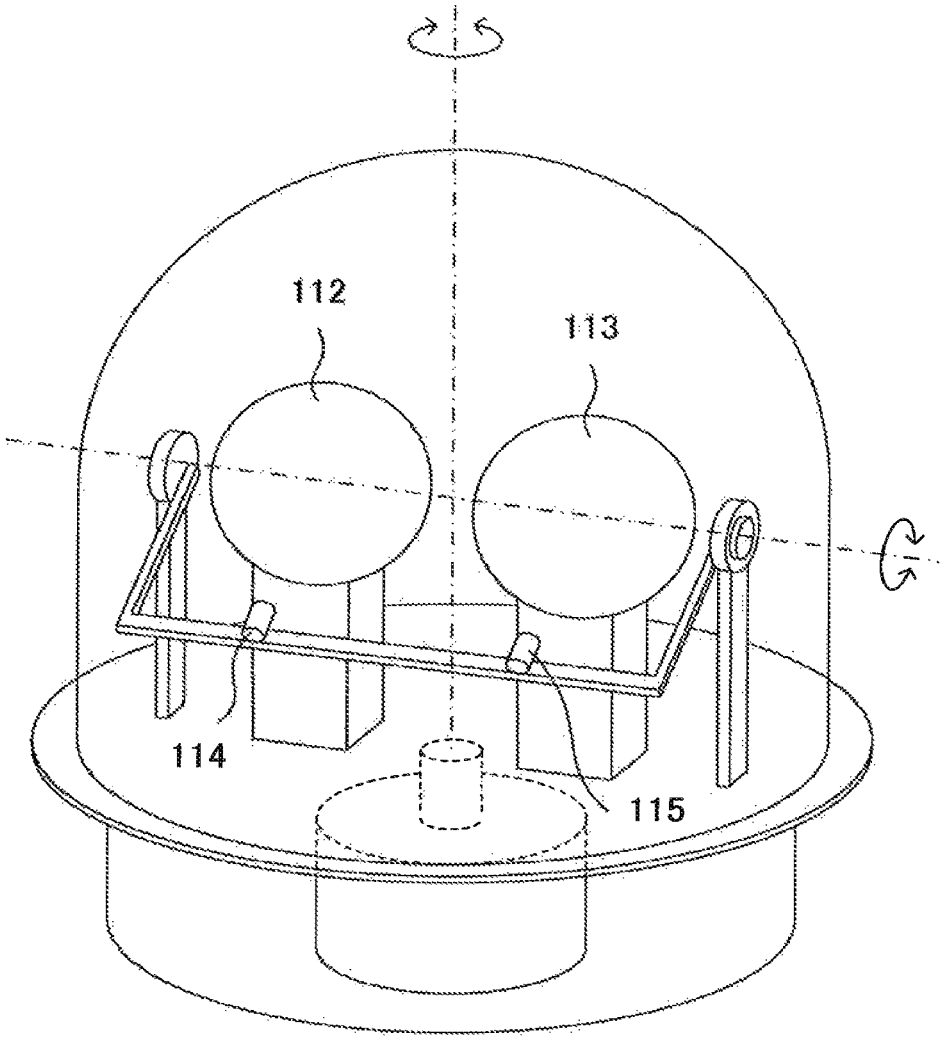
Fig. 14 PRIOR ART
FIG. 14 is a diagram illustrating a configuration of an antenna device capable of changing an elevation angle, cited in the description of the related art.

The description stated above does not mention properties in the first surface 11*a* and the second surface 11*b* of the uniform-refractive-index type lens 11. However, at the surfaces concerned, reflection occurs due to discontinuity of the medium parameters and the like. To suppress this reflection is important for efficiently outputting an electromagnetic wave. In the following, for the first surface 11*a* and the second surface 11*b*, a first matching layer 15*a* and a second matching layer 15*b* are considered. FIG. 12 is a schematic diagram illustrating the first matching layer 15*a* and the second matching layer 15*b* provided at the uniform-refractive-index type lens 11.

The first matching layer 15*a* and the second matching layer 15*b* suppress reflection and the like, on the first surface 11*a* and the second surface 11*b*, of an electromagnetic wave from the antenna 12. In other words, the first matching layer 15*a* and the second matching layer 15*b* work like a reflection prevention film.

For such matching layers, a domain (referred to as a lens surface domain in the following) of a predetermined width including the first surface 11*a* and the second surface 11*b* of the uniform-refractive-index type lens 11 is considered, and the quasiconformal mapping is performed on this lens surface domain. Needless to say, in this case, a condition to a refractive index and the like is added such a way that the first matching layer 15*a* and the second matching layer 15*b* function as a reflection prevention film.

Since the thus-acquired configuration can be regarded as one form of the above-described gradient index sub-lens, implementation by a metamaterial becomes possible.

INDUSTRIAL APPLICABILITY

According to the present invention, in wireless use such as satellite communication, train wireless communication, radar, and a cellular base station, application to antenna beam control can be made.

The present invention is described above by citing the above-described example embodiments as model examples. However, the present invention is not limited to the above-described example embodiments. In other words, according to the present invention, various configurations that can be understood by those skilled in the art can be applied within the scope of the present invention.

The present application claims priority based on Japanese patent application No. 2015-120046 filed on Jun. 15, 2015, entire disclosure of which is incorporated herein.

REFERENCE SIGNS LIST

11 Uniform-refractive-index type lens
11*a* First surface
11*b* Second surface
12 Antenna
13 Beam
14 Virtual domain
14*a* Curved plate-shaped focal plane
15*a* First matching layer
15*b* Second matching layer
17 Complex lens
21 Gradient index lens
21*a* Incident-side lens portion
21*b* Emitting-side lens portion
24 Physical domain
24*a* Planar plate-shaped focal plane
26 Gradient index sub-lens
41, 42 Gradient index lens
41*a*, 42*a* Incident-side lens portion
41*b* Emitting-side lens portion
41*c*, 42*c* Planar plate-shaped focal plane
41*d* Medium parameter adjustment element
42*d* Medium parameter adjustment element
42 Gradient index lens
42*a* Incident-side lens portion
43 Planar plate-shaped focal plane
50A, 50B Antenna device
52 Rotation drive unit
53 Translational motion drive unit
53 Beam
54 Selection unit

What is claimed is:

1. A method for designing a gradient index lens with a planar focal plane, comprising:

setting a virtual domain in which a curved focal plane of a uniform-refractive-index type lens with a uniform refractive index is included in a boundary, and a physical domain in which a planar focal plane in a gradient index lens with a non-uniform refractive index is included in a boundary and which is a quasiconformal map of the virtual domain;

calculating, as a physical medium parameter in the physical domain, the quasiconformal map of a virtual medium parameter wherein the virtual medium parameter is a medium parameter including at least one of a dielectric constant and magnetic permeability characterizing the virtual domain; and designing the gradient index lens based on the physical medium parameter by spatially arranging a medium parameter adjustment element set in advance, wherein a distance from a point where an optical axis of the uniform-refractive-index type lens intersects with the curved focal plan to a center point of the uniform-refractive-index type lens satisfies Abbe's sine rule.

2. The method for designing a gradient index lens, according to claim 1, wherein the virtual domain includes a lens-to-focal-plane domain between the uniform-refractive-index type lens and the curved focal plane, and a lens domain formed by the uniform-refractive-index type lens, the virtual medium parameter includes a medium parameter in the lens-to-focal-plane domain, and a medium parameter in the lens domain, and the physical medium parameter is a quasiconformal map of the medium parameter in the lens-to-focal-plane domain and the medium parameter in the lens domain.

3. The method for designing a gradient index lens, according to claim 1, wherein the virtual domain is constituted of a lens-to-focal-plane domain between the uniform-refractive-index type lens and the curved focal plane, the virtual medium parameter includes a medium parameter in the lens-to-focal-plane domain, and the physical medium parameter is a quasiconformal map of the medium parameter in the lens-to-focal-plane domain.

4. The method for designing a gradient index lens, according to claim 1, further comprising:

performing quasiconformal mapping on a lens surface domain that is an area near two surfaces in the uniform-refractive-index type lens.

5. The method for designing a gradient index lens, according to claim 1, wherein the medium parameter adjustment element is a metamaterial with a periodic structure of an interval being sufficiently narrower than a wavelength of an electromagnetic wave to be refracted.

6. The method for designing a gradient index lens, according to claim 1, wherein the physical medium parameter is constituted by excluding a value with which a refractive index to an electromagnetic wave becomes smaller than 1.

7. An antenna device transmitting or receiving an electromagnetic wave by refracting the electromagnetic wave, comprising:

a gradient index lens designed by setting a virtual domain in which a curved focal plane of a uniform-refractive-index type lens with a uniform refractive index is included in a boundary, and a physical domain in which a planar focal plane in a gradient index lens with a non-uniform refractive index is included in a boundary and that is a quasiconformal map of the virtual domain, calculating, as a physical medium parameter in the physical domain, the quasiconformal map of a virtual medium parameter wherein the virtual medium parameter is a medium parameter including at least one of a dielectric constant and magnetic permeability characterizing the virtual domain, and spatially arranging a medium parameter adjustment element set in advance;

an antenna performing at least one of transmission and reception of an electromagnetic wave; and a direction setting mechanism regulating a transmission direction or a reception direction of the electromagnetic wave, wherein a distance from a point where an optical axis of the uniform-refractive-index type lens intersects with the curved focal plan to a center point of the uniform-refractive-index type lens satisfies Abbe's sine rule.

8. The antenna device according to claim 7, wherein the direction setting mechanism includes:

a translational motion drive unit moving the antenna along the planar plate shaped focal plane; and a rotation drive unit rotating the antenna.

9. The antenna device according to claim 7, wherein, when a plurality of the antennas are arranged along the planar plate shaped focal plane, the antenna device further comprises a selection unit selecting one antenna from a plurality of the antennas.

* * * * *